US006383702B1

(12) United States Patent
Ryu et al.

(10) Patent No.: US 6,383,702 B1
(45) Date of Patent: May 7, 2002

(54) DRY TONER OF POLYMERIZATION TYPE FOR ELECTRONIC PHOTOGRAPHY

(75) Inventors: Seung-Min Ryu, Gyeonggi-do; Seung-Soon Jang, Seoul; Soon-Nam Kim, Suwon; Jong-Moon Eun, Gyeonggi-do; Hee-Won Jung, Suwon; Moon-Soo Park, Gyeonggi-do; Soon-Gil Hong, Gyeonggi-do, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/689,742

(22) Filed: Oct. 13, 2000

(30) Foreign Application Priority Data

Oct. 13, 1999 (KR) ..... 99/44314

(51) Int. Cl.[7] ..... G03G 9/087
(52) U.S. Cl. ..... 430/108.1; 430/108.3; 430/137.15
(58) Field of Search ..... 430/108.3, 108.1, 430/137.15

(56) References Cited

U.S. PATENT DOCUMENTS 5,364,729 A 11/1994 Kmiecik-Lawrynowicz et al. ..... 430/137
5,925,488 A 7/1999 Patel et al. ..... 430/137
6,004,714 A * 12/1999 Ciccarelli et al. ..... 430/108.3
6,030,739 A * 2/2000 Ishikawa et al. ..... 430/108.3

* cited by examiner

*Primary Examiner*—John Goodrow
(74) *Attorney, Agent, or Firm*—Robert E. Bushnell, Esq.

(57) ABSTRACT

A dry toner of polymerization type for electronic photography for forming an image on a recordable medium is synthesized during a polymerization process by adding a hydrophobic silica system compound having both hydrophobic groups and hydrophilic groups and having the following chemical structure formula:

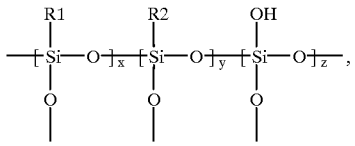

the silica system compound being a stabilizer in a polymerization composition.

43 Claims, No Drawings

DRY TONER OF POLYMERIZATION TYPE FOR ELECTRONIC PHOTOGRAPHY

CLAIM OF PRIORITY

This application makes reference to, incorporates the same herein, and claims all benefits accruing under 35 U.S.C. 119 from an application for DRY TONER OF POLYMERIZATION TYPE FOR ELECTRONIC PHOTOGRAPHY earlier filed in the Korean Industrial Property Office on the 13$^{th}$ of Oct. 1999 and there duly assigned Serial No. 44314/1999.

BACKGROUND OF THE INVENTION

1. Field of the Invention

The present invention relates to a dry toner for electronic photography, and more particularly, to a dry toner of polymerization type in which a silica system compound is used as stabilizer for the polymerization process.

2. Description of the Related Art

In general, a dry toner is used in an electronic photography apparatus and is a material used to form an image on a recordable medium. Typically, a dry toner contains a coloring pigment, a high molecular weight resin for fixing the coloring pigment to a recordable medium, a charge control agent for controlling a charged amount of the toner and a release agent for preventing the toner fixed on the recordable medium from adhering to a fuser roll. Toner particles further include external additives to bestow functionality to or enhance physical properties of the toner. In these dry toners, it is generally necessary to freely control the size of the toner particles.

One type of dry toner is the pulverization type. A dry toner of pulverization type is formed by mixing a high molecular weight resin, a coloring pigment of carbon black, a charge control agent and a release agent, colliding the mixture with a collision plate using a strong vortex to thereby pulverize the mixture into fine particles and screening the fine pulverized particles using the vortex.

Many kinds of resins may be used in the dry toner of pulverization type, but this type of dry toner has a drawback of high manufacturing cost due to the investment costs of equipment for performing the pulverizing and screening processes. There is an additional drawback in the quality of the manufactured goods, since it is very difficult to control the size of the toner particles. Furthermore, due to the low uniformity of the particles sizes, poor picture quality results.

Another type of dry toner is the polymerization type which is synthesized by using a monomer of a common thermoplastic resin, a coloring pigment, a polymerization initiator, a charge control agent and a release agent. Differently from the dry toner of pulverization type, the particle size of the dry toner of polymerization type may be controlled depending on the polymerization conditions, that is, kinds and concentration of stabilizer, amount of polymerization initiator, speed of the stirring and time and temperature of polymerization. Among these conditions, the kind and concentration of the stabilizer are the factors generally affecting the particle size to the largest degree.

Stabilizer encircles the surface of a molecular aggregate of fine spherical shaped monomers created from the solvent during the suspension polymerization reaction and maintains the dispersion such that coagulation does not occur between these molecular aggregates. The polymerization reaction occurs within the molecular aggregate of the fine spherical shape encircled by the stabilizer.

The stabilizers are hydrophilic and they show a superior dispersion characteristic with respect to the solvent, that is, water. However, when the stabilizers are applied to the dry toner, it is difficult to remove the stabilizer from the toner particles after the polymerization reaction has been completed. In addition, the residual stabilizer degenerates the picture quality of transferred images.

Moreover, after the polymerization reaction has been completed, it is troublesome to withdraw the stabilizer from the solvent, which badly affects the environment. This may be a serious problem depending on components of the stabilizer.

As a stabilizer used in the polymerization reaction of dry toners, there is a phosphoric salt system compound or hydrophilic silica system compound. General stabilizers used for suspension polymerization reaction, for example, gelatin, methyl cellulose, polyvinyl alcohol, polymethacrylic acid are applied.

Phosphoric salt system compound, however, has a low stability and a low reproduction capability and also has a drawback in that it is difficult to separate the phosphoric salt system compound from toner particles. In addition, since phosphorous is contained in the phosphoric salt system compound, the phosphoric salt system compound acts as a source of environmental contamination.

The particle size of hydrophilic silica system stabilizer is too fine to control size of the toner particle. Also, the hydrophilic silica system stabilizer is very strongly hydrophilic, so that it is difficult to separate the hydrophilic silica system stabilizer from the toner particle after the polymerization reaction has been completed. Moreover, gelatin, methyl cellulose, polyvinyl alcohol and polymethacrylic acid are strongly hydrophilic, so that it is difficult to separate them from the toner particle after the polymerization reaction has been completed.

Examples of toners of the conventional art are seen in the following U.S. Patents.

U.S. Pat. No. 5,364,729, to Kmiecik-Lawrynowicz et al., entitled TONER AGGREGATION PROCESS, discloses a dry toner which is synthesized by forming an aggregate of monomers electrostatically. However, this patent has a drawback in that the reproduction of the dry toner as formed is substantially very low.

U.S. Pat. No. 5,925,488, to Patel et al., entitled TONER PROCESSES USING IN-SITU TRICALCIUM PHOSPATE [sic] discloses a dry toner which is synthesized by using a stabilizer of tricalcium phosphate. However, this patent has a drawback in that the stabilizer of tricalcium phosphate has a very low stability and badly affects the environment.

SUMMARY OF THE INVENTION

It is therefore an object of the present invention to provide an improved dry toner.

Another object of the present invention is to provide an improved fabrication process for a dry toner.

Yet another object of the invention is to provide an improved polymerization process in the fabrication process of dry toner for electronic photography apparatus, thereby providing a dry toner for electronic photography in which the size of the toner particles is freely controlled, uniformity in the particle size is enhanced and quality of the manufactured goods and picture quality of transferred image are very excellent.

It is another object of the present invention to provide a dry toner for electronic photography in which the separation rate of stabilizer from toner particles is very high and residual stabilizer does not affect the picture quality of a transferred image.

It is yet another object of the present invention to a dry toner for electronic photography which does not affect the environment.

According to the present invention, a dry toner is synthesized during a polymerization process by adding a stabilizer which is a silica system compound, that is, a silicon-containing compound, having both properties of hydrophobicity and hydrophilicity and having the following chemical structure formula 1:

Structural formula 1

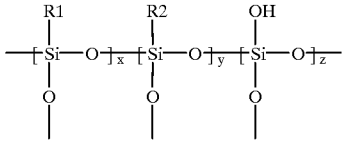

wherein the silica system stabilizer has a three dimensional network structure due to crosslinking of the units of the compound. In this structural formula, x, y and z represent relative mole fractions of the corresponding units in the compound. R1 and R2 are independently selected from an aliphatic compound of $C_1$ to $C_{30}$, an aliphatic compound of $C_1$ to $C_{30}$ having at least one functional group (G), a heteroaliphatic compound of $C_1$ to $C_{30}$, a heteroaliphatic compound of $C_1$ to $C_{30}$ having at least one functional group (G), a cycloaliphatic compound, a cyclo aliphatic compound having at least one functional group (G), a heterocyclic aliphatic compound of $C_1$ to $C_{30}$, a heterocyclic aliphatic compound of $C_1$ to $C_{30}$ having at least one functional group (G), an aromatic compound of $C_1$ to $C_{30}$, an aromatic compound having at least one functional group (G). Here, independently selected means that R1 may be the same as R2.

Here, the functional group G is selected from amide (—CONH—), imine (—CH═N—), amidino (—$N(NH_2)_2$), amine (—NRH, where R is an alkyl group), hydrazine (—$NHNH_2$), hydrazone (—N═NH), halide, hydroxy, nitro (—$NO_2$), cyano (—CN), thiocyano (—SCN), thiol (—SH), carboxylic acid (—COOH), carboxylate salt (COO—$M^+$, where M is an alkali metal), sulfonic ($SO_3H$), alkali sulfonate acid($SO_3$—$M^+$), phosphoric acid(—$OPO_3H_2$), alkali salt of phosphate (—$OPO_3H$—$M^+$).

Preferably, the silica group stabilizer is contained by 0.1 to 2 wt % in the polymerization composition.

Preferably, the silica group stabilizer is contained by 0.1 to 0.2 wt % in the polymerization composition.

Preferably, the polymerization composition contains a general-purpose thermoplastic resin monomer and the general-purpose thermoplastic monomer is contained by 15 to 30 wt % in the polymerization composition. Many polymerization systems may be used in the present invention. Examples of thermoplastic monomers include: 1) styrene and α-methylstyrene; 2) acrylic acid and methacrylic acid; 3) acrylic acid and methacrylic acid derivatives such as methyl acrylate, ethyl acrylate, propyl acrylate, 2-ethyl hexyl acrylate, dimethylaminoethyl acrylate, methyl methacrylate, ethyl methacrylate, proply methacrylate and butyl methacrylate.

Preferably, the polymerization composition contains a solvent and the solvent is contained by 51.5 to 78.8 wt % in said polymerization composition.

Preferably, the solvent is formed by adding an acid solution or an alkaline solution of 0.1 to 10 wt % to water.

Preferably, the polymerization composition contains a coloring pigment of 5 to 10 wt %, a polymerization initiator of 0.1 to 2 wt %, a charge control agent of 1 to 4 wt %, and a wax group release agent of 0.1 to 0.5 wt %.

DETAILED DESCRIPTION OF TILE PREFERRED EMBODIMENTS

Embodiment (1) Dispersion of stabilizer

Distilled water is made basic by adding an alkaline compound, and then a silica system compound having both hydrophobic and hydrophilic groups is added as a stabilizer to the water. The silica system compound has the following structure formula 2. The structure formula 2 corresponds to a case in structural formula 1 in which R1 and R2 are both $CH_3$.

Structure formula 2

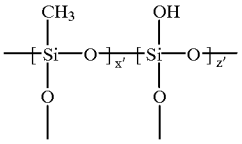

where x': z'=7:3.

The distilled water and the silica system compound are stirred for 5 minutes at a speed of 5,000 rotations per minute (rpm). Then, an acid solution is added to the stirred solution to neutralize the stirred solution. As the result of the above processes, a dispersed solution of the stabilizer is formed.

(2) Formation of preliminary particles prior to polymerization

A monomer mixture of styrene and butyl methacrylate is added to the previously prepared dispersed solution and then is stirred for 5 minutes at a speed of 5,000 rpm to disperse the monomer mixture. As the result of the above processes, a solution having preliminary particles is formed.

(3) Dose of additive

A coloring pigment of carbon black, a polymerization initiator of 2,2-azobis isobutylonitrilie made by Junsei Chemical Co., Ltd, a charge control agent of Bontron S-54 made by Orient Chemical Co., Ltd and a release agent of polypropylene wax are administered into the solution having preliminary particles.

(4) Polymerization

The solution containing the additives is stirred under a nitrogen atmosphere at a reaction temperature of 50° C. at a speed of 300 rpm.

(5) Retrieval of toner particle after the polymerization

Toner particles created after the polymerization are separated using an aspirator and are then dried.

Table 1 shows various amounts of components used in the embodiment of the present invention.

TABLE 1

| SUBSTANCE | Ex. 1 | Ex. 2 | Ex. 3 | Ex. 4 | Ex. 5 | Ex. 6 |
|---|---|---|---|---|---|---|
| Styrene | 140 ml | 140 ml | 140 ml | 140 ml | 140 ml | 140 ml |
| Butyl methacrylate | 60 ml | 60 ml | 60 ml | 60 ml | 60 ml | 60 ml |

TABLE 1-continued

| SUBSTANCE | Ex. 1 | Ex. 2 | Ex. 3 | Ex. 4 | Ex. 5 | Ex. 6 |
|---|---|---|---|---|---|---|
| Stabilizer | 2 g | 4 g | 6 g | 10 g | 15 g | 20 g |
| Initiator | 2 g | 2 g | 2 g | 2 g | 2 g | 2 g |
| Release agent | 1.6 g | 1.6 g | 1.6 g | 1.6 g | 1.6 g | 1.6 g |
| Water* | 600 ml | 600 ml | 600 ml | 600 ml | 600 ml | 600 ml |

*it is meant that this water contains acid or base solution to disperse the stabilizer.

Conventional Embodiment for Comparision with the Above Embodiment

In a conventional embodiment, a dry toner is fabricated by the same process with that of the embodiment of the present invention. Separately, as a stabilizer for maintaining dispersion of molecular assembly of monomers in the solvent, a polyvinyl alcohol is used.

TABLE 2

| SUBSTANCE | Ex. 1 | Ex. 2 | Ex. 3 |
|---|---|---|---|
| Styrene | 140 ml | 140 ml | 40 ml |
| Butyl methacrylate | 60 ml | 60 ml | 60 ml |
| Stabilizer | 1 g | 2 g | 4 g |
| Initiator | 2 g | 2 g | 2 g |
| Release agent | 1.6 g | 1.6 g | 1.6 g |
| Water * | 600 ml | 600 ml | 600 ml |

* it is meant that this water contains acid or base solution to disperse the stabilizer.

Evaluation Result

The following items are measured and compared between the embodiment of the present invention and the conventional embodiment.

(1) Average diameter and uniformity of toner particles: Average diameter and uniformity of toner particles are measured by using a laser particle size spectroscopy. After dispersing toner particles into water or alcohol, a diffraction angle that occurred upon the projection of a He—Ne laser beam having a wavelength of 632.9 nm was measured. An average diameter and uniformity of the particles were computed from the measured diffraction angle.

(2) Residual amount of the stabilizer: An amount of the stabilizer contained in the solvent separated from the withdrawn toner particles after the polymerization process is completed is measured by using a liquid chromatography. From the measured amount of the stabilizer, a residual amount of the stabilizer remaining in the toner particles was computed.

As shown in Table 3, dry toners of the present invention, such as Ex. 1 to Ex. 6 which were synthesized by using a silica system stabilizer having both hydrophobicity and hydrophilicity, allow free control of the size of the toner particles. Also, the uniformity of the toner particle size is enhanced and the picture quality of a transferred image is superior because the residual amount of the stabilizer remaining in the toner particles is relatively low.

Meanwhile, in conventional dry toners, such as C. Ex. 1 to C. Ex. 3, which are synthesized by using only a hydrophilic stabilizer, it is difficult to control the size of the toner particles and this leads to a problem in quality of manufactured goods. Also, as the toner particles have a low uniformity, a residual amount of the stabilizer remaining in the toner particles becomes high, which results in low picture quality of a transferred image.

As described above, since the dry toner of the present invention uses a hydrophobic silica system compound as the stabilizer, the size of the toner particles can be freely controlled, which results in the good quality of the manufactured goods.

Moreover, the dry toner of the present invention can be easily withdrawn from the used water after the polymerization process has been completed and the hydrophobic silica system stabilizer has no harmfulness. That is, it is environmentally friendly.

This invention has been described above with reference to the aforementioned embodiments. It is evident, however, that many alternatives, modifications and variations will be apparent to those having skill in the art in the light of the foregoing description. Accordingly, the present invention embraces all such alternatives, modifications and variations as fall within the spirit and scope of the appended claims and their equivalents.

What is claimed is:

1. A toner, comprising:

a thermoplastic resin prepared from a solution including:

a stabilizer comprising a silicon compound, said silicon compound comprising a first structural unit of structural formula

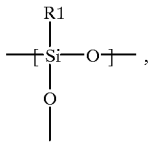

,

TABLE 3

| Items | Ex. 1 | Ex. 2 | Ex. 3 | Ex. 4 | Ex. 5 | Ex. 6 | C. Ex. 1 | C. Ex. 2 | C. Ex. 3 |
|---|---|---|---|---|---|---|---|---|---|
| Aver. Diameter | 96.24μ | 40.06μ | 23.35μ | 14.43μ | 14.98μ | 9.53μ | 16.27μ | 12.40μ | 11.97μ |
| Uniformity* | 45.9% | 46.5% | 47.2% | 47.7% | 48.1% | 48.8% | 35.3% | 35.8% | 36.4% |
| Residual Amount of Stabilizer | 0.5% | 0.5% | 0.5% | 0.6% | 0.7% | 0.8% | 1.9% | 2.0% | 2.2% |

a second structural unit of structural formula

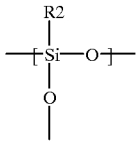

and a third structural unit of structural formula

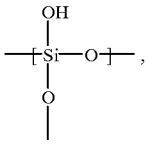

were R1 and R2 are independently selected from the group consisting essentially of an aliphatic compound of $C_1$ to $C_{30}$, an aliphatic compound of $C_1$ to $C_{30}$ including at least one functional group (G), a heteroaliphatic compound of $C_1$ to $C_{30}$, a heteroaliphatic compound of $C_1$ to $C_{30}$ including at least one functional group (G), a cycloaliphatic compound, a cycloaliphatic compound including at least one functional group (G), a heterocyclic aliphatic compound of $C_1$ to $C_{30}$, a heterocyclic aliphatic compound of $C_1$ to $C_{30}$ including at least one functional group (G), an aromatic compound of $C_1$ to $C_{30}$, and an aromatic compound including at least one functional group (G);

where G is selected from the group consisting essentially of amide (—CONH—), imine (—CH=N—), amidino (—$N(NH_2)_2$), amine (—NRH, where R is an alkyl group), hydrazine (—$NHNH_2$), hydrazone (—N=NH), halide, hydroxy, nitro (—$NO_2$), cyano (—CN), thiocyano (—SCN), thiol (—SH), carboxylic acid (—COOH), carboxylate salt (COO—$M^+$, where M is an alkali metal), sulfonic ($SO_3H$), alkali sulfonate acid($SO_3$—$M^+$), phosphoric acid(—$OPO_3H_2$), and alkali salt of phosphate (—$OPO_3H$—$M^+$);

said silicon compound being a three-dimensional network structure of cross-linking of said first structural unit, said second structural unit and said third structural unit of said silicon compound; and a thermoplastic resin monomer.

2. The toner of claim 1, further comprised of said first structural unit and said second structural unit both being of structural formula

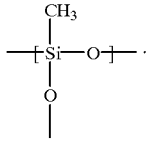

3. The toner of claim 1, further comprised of said thermoplastic resin monomer selected from the group consisting essentially of styrene, α-methylstyrene, acrylic acid, methacrylic acid and methacrylic acid derivatives.

4. The toner of claim 2, further comprised of said thermoplastic resin monomer selected from the group consisting essentially of styrene, α-methylstyrene, acrylic acid, methacrylic acid and methacrylic acid derivatives.

5. The toner of claim 4, further comprised of said thermoplastic resin being a polymer formed from styrene and butyl methacrylate.

6. The toner of claim 1, further comprised of a mole ratio of said first structural unit plus said second structural unit to said third structural unit in said silicon compound being greater than 6:4.

7. The toner of claim 2, further comprised of a mole ratio of said first structural unit and said second structural unit to said third structural unit in said silicon compound being 7:3.

8. The toner of claim 1, further comprising:

a coloring pigment.

9. The toner of claim 2, further comprising:

a coloring pigment.

10. A method of making a toner, comprising the steps of:

preparing a solution comprising:

a thermoplastic resin monomer;

a stabilizer comprising a silicon compound, said silicon compound comprising a first structural unit of structural formula

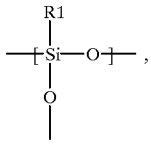

a second structural unit of structural formula

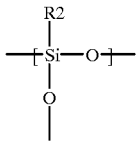

and a third structural unit of structural formula

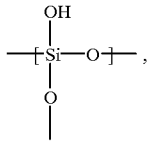

where R1 and R2 are independently selected from the group consisting essentially of an aliphatic compound of $C_1$ to $C_{30}$, an aliphatic compound of $C_1$ to $C_{30}$ including at least one functional group (G), a heteroaliphatic compound of $C_1$ to $C_{30}$, a heteroaliphatic compound of $C_1$ to $C_{30}$ including at least one functional group (G), a cycloaliphatic compound, a cycloaliphatic compound including at least one functional group (G), a heterocyclic aliphatic compound of $C_1$ to $C_{30}$, a heterocyclic aliphatic compound of $C_1$ to $C_{30}$ including at least one functional group (G), an aromatic compound of $C_1$ to $C_{30}$, and an aromatic compound including at least one functional group (G);

where G is selected from the group consisting essentially of amide (—CONH—), imine (—CH=N—), amidino (—$N(NH_2)_2$), amine (—NRH, where R is an alkyl group), hydrazine (—$NHNH_2$), hydrazone (—N=NH), halide, hydroxy, nitro (—$NO_2$), cyano (—CN), thiocyano (—SCN), thiol (—SH), carboxylic acid (—COOH), carboxylate salt (COO—$M^+$, where M is an alkali metal), sulfonic ($SO_3H$), alkali sulfonate acid($SO_3$—$M^+$), phosphoric acid(—$OPO_3H_2$), and alkali salt of phosphate (—$OPO_3H$—$M^+$);

said silicon compound being a three-dimensional network structure of cross-linking of said first structural unit, said second structural unit and said third structural unit of said silicon compound; and a coloring pigment; and polymerizing said thermoplastic resin monomer in said solution to form toner particles.

11. The method of claim 10, further comprised of said silicon compound being at a concentration in a range of from 0.1 to 2% by weight in said solution.

12. The method of claim 10, further comprised of a mole ratio of said first structural unit plus said second structural unit to said third structural unit in said silicon compound being greater than 6:4.

13. The method of claim 10, further comprised of said thermoplastic resin monomer being in a range of from 15 to 30% by weight in said solution.

14. The method of claim 10, further comprised of said solution further comprising a solvent which is in a range of from 51.5 to 78.8% by weight of said solution.

15. The method of claim 14, further comprised of said solvent being a solution in a range of from 0.1 to 10% by weight of one of an acidic compound or an alkaline compound in water.

16. The method of claim 10, further comprised of a concentration of said coloring pigment being in a range of from 5 to 10% by weight of said solution.

17. The method of claim 10, further comprised of said solution further comprising a polymerization initiator.

18. The method of claim 17, further comprised of said polymerization initiator being in a range of approximately from 0.1 to 2% by weight of said solution.

19. The method of claim 10, further comprised of said solution further comprising a charge control agent.

20. The method of claim 19, further comprised of said charge control agent being in a range of approximately from 1 to 4% by weight of said solution.

21. The method of claim 10, further comprised of said solution further comprising a wax group release agent.

22. The method of claim 21, further comprised of said wax group release agent being in a range of approximately from 0.1 to 0.5% by weight of said solution.

23. The method of claim 10, further comprised of said first structural unit and said second structural unit both being of structural formula

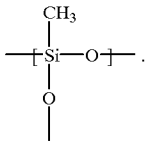

24. The method of claim 10, further comprised of said thermoplastic resin monomer being selected from the group consisting essentially of styrene, α-methylstyrene, acrylic acid, methacrylic acid and methacrylic acid derivatives.

25. The method of claim 23, further comprised of said solution comprising styrene and butyl methacrylate.

26. The method of claim 10, further comprised of said step of preparing said solution further comprising the steps of:

dispersing said silicon compound in an alkaline aqueous solution to form a dispersion of said silicon compound; then dispersing said thermoplastic resin monomer in said dispersion of said silicon compound; and then adding said coloring pigment to said dispersion of said silicon compound including said thermoplastic resin monomer.

27. The method of claim 10, further comprised of said step of polymerizing said thermoplastic resin monomer further comprising the step of:

stirring said solution under nitrogen at a temperature of approximately 50° C.

28. The method of claim 10, further comprising the step of:

separating and drying said toner particles.

29. The method of claim 10, further comprised of said coloring pigment being carbon black.

30. Toner particles prepared by the method of claim 10.

31. Toner particles prepared by the method of claim 23.

32. Toner particles prepared by the method of claim 25.

33. The toner of claim 1, said solution further comprised of said silicon compound being at a concentration in a range of from 0.1 to 2% by weight in said solution.

34. The toner of claim 1, said solution further comprised of said thermoplastic resin monomer being in a range of from 15 to 30% by weight in said solution.

35. The toner of claim 1, said solution further comprising a solvent which is in a range of from 51.5 to 78.8% by weight of said solution.

36. The toner of claim 35, further comprised of:

said solvent being water; and said solution further comprising one of an acidic solution or an alkaline solution which is in a range of from 0.1 to 10% by weight of said water.

37. The toner of claim 1, said solution further comprising a polymerization initiator.

38. The toner of claim 37, further comprised of said polymerization initiator being in a range of approximately from 0.1 to 2% by weight of said solution.

39. The toner of claim 1, said solution further comprising a charge control agent.

40. The toner of claim 39, further comprised of said charge control agent being in a range of approximately from 1 to 4% by weight of said solution.

41. The toner of claim 1, said solution further comprising a release agent.

42. The toner of claim 41, further comprised of said release agent being a wax group release agent which is in a range of approximately from 0.1 to 0.5% by weight of said solution.

43. The toner of claim 8, further comprised of a concentration of said coloring pigment being in a range of from 5 to 10% by weight of said solution.

* * * * *